US005250378A

United States Patent [19]

Wang

[11] Patent Number: 5,250,378

[45] Date of Patent: Oct. 5, 1993

[54] CHARGE TRANSFER COMPLEXES AND PHOTOCONDUCTIVE COMPOSITIONS CONTAINING FULLERENES

[75] Inventor: Ying Wang, Wilmington, Del.

[73] Assignee: E. I. Du Pont de Nemours and Company, Wilmington, Del.

[21] Appl. No.: 954,181

[22] Filed: Sep. 30, 1992

Related U.S. Application Data

[63] Continuation-in-part of Ser. No. 777,849, Oct. 16, 1991, abandoned.

[51] Int. Cl.[5] ..... G03G 5/06; G03G 5/09

[52] U.S. Cl. ..... 430/83; 430/56; 430/71; 430/900; 252/501.1; 359/328

[58] Field of Search ..... 430/56, 71, 83, 900; 252/501.1

[56] References Cited

U.S. PATENT DOCUMENTS

| | | | |
|---|---|---|---|
| 4,692,636 | 9/1987 | Wang | 307/427 |
| 4,922,827 | 5/1990 | Remo | 102/496 |
| 5,166,016 | 11/1992 | Badesha et al. | 430/56 |
| 5,171,373 | 12/1992 | Hebard et al. | 136/252 |
| 5,178,980 | 1/1993 | Mort et al. | 430/58 |

OTHER PUBLICATIONS

Borsenberger et al., "An aggregate organic photoconductor". II. Photoconduction properties:, J. Appl. Phys. 49(11), 1978, pp. 5555-5564.

Dulmage et al., J. Appl. Phys. 49(11), 1978, pp. 5543-5554.

Hoegl, "On Photoelectric Effects in Polymers and Their Sensitization by Dopants", J. Phys. Chem., pp. 755-766 (1965).p Nash, Time Magazine, "Great Balls of Carbon", May 6, 1991, p. 66.

Amato, Science, "Buckyballs, Hairyballs, Dopeyballs", vol. 252, Apr. 12, 1991, p. 646.

Kratshmer et al., Nature, "Solid $C_{60}$: A new form of carbon":, vol. 347, Sep. 27, 1990, pp. 354-358.

Baum, Chemical and Engineering News, "Simple Synthesis of $C_{60}$ Molecule Triggers Intense Research Effort", Oct. 29, 1990, pp. 22-25.

Diederich et al., Science, vol. 252, 548-551 (Apr, 26, 1991).

Shinohara et al., J. Phys. Chem., vol. 95, 8449-8451 (1991).

Smart et al., Chem. Phys. Lett., vol. 188, No. 3,4, 171-176 (1992).

Kikuchi et al., Chem. Phys. Lett., vol. 188, No. 3,4, 177-180 (1992).

*Primary Examiner*—Roland Martin

[57] ABSTRACT

The disclosed invention relates to novel charge-transfer complexes comprising fullerenes and electron donating components, and to photoconductive compositions containing fullerenes. These compositions are useful in electrostatic imaging.

17 Claims, 3 Drawing Sheets

CHARGE TRANSFER COMPLEXES AND PHOTOCONDUCTIVE COMPOSITIONS CONTAINING FULLERENES

This is a continuation-in-part of application Ser. No. 07/777,849 filed Oct. 16, 1991, now abandoned.

FIELD OF THE INVENTION

This invention relates to photoconductive elements, and to compositions for use in such photoconductive elements

BACKGROUND OF THE INVENTION

Charge transfer complexes generally are known in the art. See "Organic Charge-Transfer Complexes", R. Foster, Academic Press, New York, 1969, and A. Weller, "Exciplex", edited by M. Gordon; W. R. Ware, Academic Press, NY, 1975. A charge-transfer complex, as known in the art, is formed by interaction of two or more component molecules which are in reversible equilibrium. No covalent bonding exists between the components. Charge transfer complexes are bound together by the partial donation of electrons from at least one component molecule to at least one other component molecule.

Photoconductive inorganic materials, such as zinc oxide and selenium, have been recognized for years as useful in applications such as electrostatic imaging due to their high photosensitivity. The need for better, less expensive and more flexible photoconductors has prompted the art to investigate organic materials as possible photoconductors.

A variety of organic materials, such as photoconductive polymers, and compositions comprising low molecular weight organic compounds embedded in non-photoconducting polymers, were found to have promising properties. A useful review of such materials is detailed by H. Hoegl, "J. Phys. Chem.", 69, 755-766 (1965). In spite of the previous studies on organic materials, the need exists for organic materials which have photoconductive properties comparable to inorganic materials.

Recently, large all-carbon molecules known as fullerenes have been isolated. See Diederich et al., Science, Vol. 252, 548-551 (Apr. 26, 1991); Shinohara et al., J. Phys. Chem., Vol. 95, 8849-8451 (1991); Smart et al., Chem. Phys. Lett., Vol. 188, No. 3, 4, 171-176 (1992); and Kikuchi et al., Chem. Phys. Lett., Vol. 188, No. 3, 4, 177-180 (1992). The present invention provides charge-transfer complexes and photoconductive compositions containing fullerenes.

SUMMARY OF THE INVENTION

The invention relates to novel charge-transfer complexes comprising fullerenes and electron donating components, and to photoconductive compositions containing either fullerenes alone or fullerenes together with charge transfer complexes. These compositions are useful in electrostatic imaging. The photoconductive compositions have at least one organic material selected from photoconductive polymers, low molecular weight electron donor compounds, or mixtures thereof, and 0.1 to 50.0% by weight, based on the total weight of the photoconductive composition, of at least one fullerene compound having from 20 to 1000 carbons. In a further embodiment, the photoconductive composition includes at least one organic material selected from non-photoconductive polymers, low molecular weight electron donor compounds, or mixtures thereof, and 0.1 to 50% by weight, based on the total weight of the photoconductive composition, of a charge transfer complex formed of a fullerene compound having from 20 to 1000 carbons, and an electron donating component.

This invention further provides for a charge-transfer complex formed of an electron accepting component that include at least one fullerene compound having from 20 to 1000 carbons, preferably from 60 to 70 carbons, and an electron donating component. The ratio of electron donating component: fullerene compound can range from 1:3 to 6:1, most preferably from 1:1 to 3:1. In charge-transfer complexes that have fullerenes with sixty carbons, the electron donating component may be any organic molecule whose oxidation potential is less than 1.38 V against $Ag/Ag^+$. In charge transfer complexes that have fullerenes with seventy carbons, the electron donating component may be any organic molecule whose oxidation potential is less than 1.29 V against $Ag/Ag^+$. Most preferred electron donating components are N, N-diethyl-aniline, and polyvinyl carbazole.

Having briefly summarized the invention, the invention will now be described in detail by reference to the following specification and non-limiting examples. Unless otherwise specified, all percentages are by weight and all temperatures are in degrees Celsius.

DETAILED DESCRIPTION OF THE INVENTION

Figure 1:
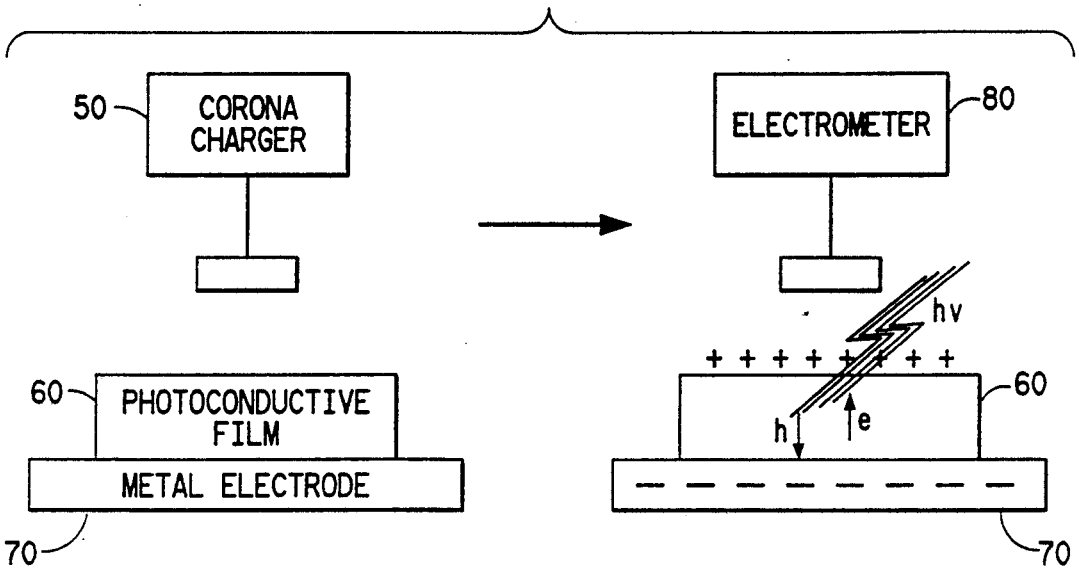
FIG. 1 is a schematic view of an apparatus for measurement of the photo-induced discharge of the photoconductive materials of the invention.

Generally, the charge-transfer complexes of this invention are made by first dissolving individual electron donating and electron accepting components in separate solvents to provide solutions, and then mixing those solutions. Alternatively, one component can be dissolved in a solvent, followed by addition of other components. The properties of charge-transfer complexes can be measured either in solution, or as solids precipitated from solution by the addition of a poor solvent. In the case of fullerene/N, N-diethylaniline charge transfer complexes, methanol or ethanol can be used to precipitate the charge-transfer complexes. Properties of the complexes can be determined by methods known in the art, such as EFISH (electric field induced second harmonic generation).

The charge transfer complexes can be prepared as thin films either by sublimation of the solids or by slowly evaporating a solution of the complex onto a substrate such as glass. Such methods are known in the art. The charge transfer complexes can also be doped into polymers such as polycarbonate, and cast into thin films by spin-coating as is known in the art. See, for example, U.S. Pat. No. 4,692,636.

In order to form the charge-transfer complex, the energy of the charge-transfer complex, $E^{CT}$, as shown in equation (1), should be lower than the first excited state energy of either the electron donor, $E^D$, or the electron acceptor, $E^A$, that is, $$E^{CT} < E^D \text{ or } E^A \quad (1).$$

The first excited energy state of the donor or the acceptor can be obtained from the first peak of their respective absorption spectra. The energy of the charge-transfer complex, $E^{CT}$, is determined by Equation (2):

$$E^{CT} = E_{ox}{}^D - E_{red}{}^A + 0.32 \pm 0.1\,V \quad (2).$$

Equation 2 is set forth in A. Weller, "Exciplex", edited by M. Gordon; W. R. Ware, Academic Press, NY, 1975.

As set forth in Equation (2), $E_{OX}{}^D$ is the oxidation potential of the electron donor component and $E_{red}{}^A$ the reduction potential of the electron acceptor component. Both the oxidation and reduction potentials can be determined experimentally by electrochemical methods. See, for example, Siegerman, in "Techniques of Electroorganic Synthesis", Part II, ed. N. L. Weinberg, in "Techniques of Chemistry", Vol. V, John-Wiley & Sons, New York, 1975.

The charge-transfer complexes provided in accordance with this invention can be utilized per se as nonlinear optical elements or can be utilized as photoconductors, visible and infrared sensitizers, initiators for photopolymerization, reinforcement of polymers and pigments.

The formation of a charge-transfer complex in accordance with this invention is accompanied by the appearance of a new absorption band in either the ultraviolet, infra-red or visible absorption spectrum of the charge transfer complex. This new absorption band corresponds to the transition of the components to an excited state where a more complete transfer of electrons from the electron donor to the electron acceptor occurs. The formation of a charge-transfer complex can therefore be detected by change of the absorption spectrum of the electron accepting component when mixed with the electron donating component.

The electron donating component of the charge-transfer complex of the invention is preferably an organic compound which is electron donating in character. Electron donating components are well known in the art. Electron donating components useful in forming charge-transfer complexes with electron accepting compounds are pointed out in A. Weller and R. Foster referred to above. N, N-diethylaniline is particularly preferred as an electron donating component for reasons of economics and ease of availability. However, other suitable electron donating components include polycyclic aromatics, particularly anthracence and pyrenes, amines such as N, N-dimethylaniline, stilbene derivatives such as trans-stilbene, metallocenes such as ferrocene, and paracyclophanes such as [2, 2]paracyclophane. Representative examples of electron donating components that may be used to form the charge-transfer complexes of this invention are shown in Foster, Organic Charge-Transfer Complexes, p. 69, Ed. Blomquart, (1969).

The choice of electron donating component depends on the oxidation potential of the electron acceptor component according to the relationships defined in eq. (1) and (2). For $C_{60}$ and $C_{70}$ fullerene electron acceptor components, the first reduction potentials, $E_{red}{}^A$, have been determined to be −0.4 V against Ag/Ag+electrode (Haufler et al., J. Phys. Chem., Vol. 94, pages 8634–8636 (1990) and Allemand et al., J. Am. Chem. Soc., Vol 113, pages 1050–1051 (1991)). The first excited state energies of $C_{60}$ and $C_{70}$ fullerenes of 2.0 eV and 1.91 eV, respectively, have been determined from their absorption spectra where the first peaks of those absorption spectra correspond to the first excited state. Accordingly, electron donors useful with $C_{60}$ and $C_{70}$ fullerenes show $E_{ox}{}^D < 1.38$ V against $Ag/Ag^+$ for $C_{60}$ $E_{ox}{}^D < 1.29$ V against $Ag/Ag^+$ for $C_{70}$ The value of $E_{ox}{}^D$ can be routinely measured electrochemically against standard electrodes such as Ag, saturated calomel, or normal hydrogen. Siegerman referred to above discusses techniques for measuring $E_{ox}{}^D$ and provides a list of oxidation potentials of common organic molecules The fullerene electron acceptor component useful in the charge-transfer complexes of this invention can be made by the procedures described by Kratschmer et al., *Nature*, pp. 347–354 (1990). Electrochemical studies on fullerenes, e.g., Haufler et al., J. Phys. Chem., Vol. 94, pp. 8634–8636 (1990) and Allemand et al., J. Am. Chem. Soc., Vol. 113, pp. 1050–1051 (1991), indicate the $C_{60}$ and $C_{70}$ fullerenes are excellent electron acceptors.

The fullerenes useful in this invention may have an extremely broad range of carbon atoms. Useful have 20–1000 carbon atoms. Preferably, the fullerene has 60 to 70 carbon atoms. Other examples of fullerenes that may be used to form the charge complexes of the invention are described in Zhang et al, J. Phys. Chem. Volume 90, page 525 (1986); Newton et al, J. Am. Chem. Soc., Volume 106, p. 2469 (1984); Fowler, Chem Phys. Lett., Volume 131, page 444–450 (1986), Diederich et al., Science, Volume 252, pages 548–551 (1991). It is also permissible to utilize substituted fullerene, provided that the substituted fullerene retains its electron accepting character.

The fullerene-containing photoconductive compositions provided by the invention may contain a variety of photoconductive polymers, low molecular weight electron donor compounds, or mixtures thereof. While a wide range of photoconductive polymers may be used, typical photoconductive polymers include: polysilane, polyvinylcarbazole, polystyrene, polyvinylxylene, poly-1-vinylnaphthalene, poly-2vinylnaphthalene, poly-4-vinylbiphenyl, poly-9vinylanthracene, poly-3-vinyl-pyrene, poly-2vinylquinoline, polyindene, polyacena-phthylene, poly(3, 3'-dimethyldiphenylene-4, 4'), polyacrylamide, polymethacrylamide, substituted versions thereof, and the like.

Typical low molecular weight electron donor type compounds for use in the fullerene-containing photoconductive compositions of the invention include naphthalene, biphenyl, fluorene, anthracene, phenanthrene, acenaphthrene, acenaphthylene, chrysene, pyrene, 1, 4-dimethoxybenzene, diphenylamine, 2, 2'-dinaphthylamine, 1, 5-diethoxynaphthalene, 2-phenylindole, carbazole, phenothiazine, 2, 4-bis(4'-diethylaminophenyl)-1, 3, 4-oxidiazole, 2, 4-bis(4'-diethylaminophenyl)-1, 3, 4-triazole, and the like. Other useful photoconductive polymers and low molecular weight electron donor compounds are described in H. Hoegl, J. Phys. Chem. 69, 755–766 (1965).

In accordance with this invention, it has been found that the photoconductivity of each of polymeric photoconductors, low molecular weight electron donor compounds, or mixtures thereof is significantly enhanced by addition of fullerenes in an amount from 0.1 to 50.0% by weight, based on the total weight of the photoconductive composition, preferably 1% by weight to 20.0%, based on the total weight of the photoconductive composition.

As noted, the charge-transfer complexes of this invention are also useful as additives in nonphotoconductive polymers to provide surprisingly improved photoconductive compositions, as well as to improve the photoconductivity of nonphotoconductive polymers that optionally contain low molecular weight electron donor compounds such as those described above. Useful electron donor compounds that may be employed with these nonphotoconductive polymers and charge transfer complexes include leuco bases of diaryl- and triarylmethane dyes, 1, 1, 1-triarylalkanes wherein the alkane moiety has at least two carbon atoms, and tetraarylmethanes where an amine group is substituted on at least one of the aryl groups attached to the alkane and methane moieties, and the like. Preferably, the electron donor compound is selected from the group of triarylmethane leuco dyes where the aryl groups are unsubstituted phenyl, or phenyl substituted with substituents such as alkyl and alkoxy radicals having 1 to 8 carbon atoms, hydroxy, and halogen, and the amino substituent is a p-dialkylamino group, or —NL2 where L is an alkyl radical having 1 to 8 carbon atoms. Preferably, an excess of electron donor compounds is employed where the polymeric binder is not photoconductive. The nonphotoconductive polymers may include polymethacrylate, poly(methyl methacrylate), polyaramide, poly(vinyl alcohol), copolymers of methyl methacrylate and methacrylic acid, copolymers of styrene and maleic anhydride and half ester-acids of the latter, polycarbonate, and the like. It is highly preferred that the nonphotoconductive polymer employed is soluble in solvents such as toluene and N,N-diethylaniline where the charge-transfer complexes have the highest solubility. Accordingly, a preferred nonphotoconductive polymer is polycarbonate. The charge-transfer complex employed can be present in an amount from 0.1 to 50% by weight, based on the total weight of the photoconductive composition, preferably 1 to 20% by weight, based on the total weight of the photoconductive composition.

The photoconductive compositions of this invention cause conductivity to increase in the exposed area to dissipate surface charge partially or wholly in the exposed area and to leave a substantially unaffected charge in the unexposed area. The resulting electrostatic latent image can be developed by conventional means, for example, by electrostatic toners. The developed image can be viewed directly, or as is known in the art, transferred to a receptor such as paper or a polymeric substrate by electric fields, volatile solvents, or transfer techniques such as those disclosed by Schaffert, *Electrophotography,* (Focal Press, London, 1973).

Where the photoconductive element is in the form of a self-supporting film or a coating, one side of the photoconductive element preferably contacts an electrically conductive surface during charging of that element. Where the photoconductive element is a self-supporting film, the film may be metallized on one side by, for example, aluminum, silver, copper, nickel, and the like to provide an electrically conductive layer for contacting an electrically conductive surface during charging. Alternatively, an electrically conductive surface may be provided by laminating the metallized films to provide a metal foil. As a further alternative, the photoconductive element can be brought into direct electrical contact with a conducting surface to effect charging. Good contact between the film and the conducting surface can be insured by wetting the conducting layer with water or a suitable organic liquid, such as ethanol or acetone.

The electrically conductive surface employed to charge the photoconductive element can be in the form of a plate, sheet or layer having a specific resistivity smaller than that of the photoconductive element generally less than $10^9$ ohm-cm, preferably $10^5$ ohm-cm or less. Accordingly, suitable electrically conductive surfaces include metal sheets, or insulators such as glass, polymer films, or paper which are coated with conductive coatings or wetted with conductive liquids or otherwise are made conductive.

The surface of the photoconductive elements that employ the photoconductive compositions of this invention can be charged for image retention by well known techniques such as corona discharge, contact charge, capacitive discharge, and the like. Charging preferably is performed in darkness or in subdued illumination. Either negative or positive potential can be applied. Negative potential is preferred when positively-charged developers are employed. During charging, the electrically conductive surface of the photoconductive element should be grounded.

In performing photo-imaging, the photoconductive compositions of this invention can be carried on a support or fabricated into a self-supporting photoconductive layer, grounded, and given a surface electrostatic charge. The charged surface can be given a conventional exposure to actinic radiation to produce an electrostatic latent image.

When the photoconductive elements comprising the photoconductive compositions of this invention are exposed to electromagnetic radiation, the exposed areas are discharged to leave the unexposed areas more highly charged. The resulting electrostatic image can be converted to a visible image according to standard electrophotographic development techniques. Suitable developers or toners include charged aerosols, powders, or liquids containing finely divided, charged substances which are attracted to the charged image areas. Preferably, latent images are developed by contact with a developer formed of a carrier and toner. Suitable carriers include glass balls, iron powder, plastic balls, or low boiling dielectric liquids. Useful toners include resin/pigment mixtures that have a grain size from 1 to 100 micrometers. Other useful carriers and toners may be readily determined by those skilled in the art.

The photoconductive compositions in accordance with this invention can be fabricated into a variety of photoconductive elements depending on the requirements of the photoimaging application. The photoconductive elements that comprise the photoconductive compositions of the invention can be employed in the form of, for example, self-supporting films, or as coatings on support materials. Coatings can be formed on a support material by conventional methods, for example, spraying, spin-coating, draw-coating, and the like.

Without further elaboration, it is believed that one skilled in the art can, using the preceding description, utilize the present invention to its fullest extent. The following preferred specific embodiments are, therefore, to be construed as merely illustrative, and not limiting of the disclosure in any way whatsoever.

Preparation of Fullerenes

In accordance with the methods set forth in Kratschmer et al., *Nature*, pp. 347–354 (1990), $C_{60}$ and $C_{70}$ fullerenes are prepared. ⅛" graphite rods are evaporated in a Denton DV-502 Evaporator under 150 torr of helium by passing electrical currents of 120 amperes at 20 volts through the rods. The black soot generated is collected and then extracted with toluene in a Soxhlet tube to obtain fullerenes containing mixtures of $C_{60}$, $C_{70}$ and small amount of impurities. To separate the $C_{60}$ and $C_{70}$ fullerenes. mixtures of these fullerenes are dissolved in either hexane, 5% toluene/hexane, or 20% toluene/-hexane. The resulting solution is passed through a column containing neutral alumina. $C_{60}$ (purple color) comes out of the column first, followed by $C_{70}$ (orange brown).

Preparation of $C_{60}$ and $C_{70}$ Charqe-Transfer Complexes

Fullerene/N,N-diethylaniline charge-transfer complexes are formed by dissolving fullerenes into N, N-diethylaniline. The charge-transfer complexes are precipitated as solids by adding methanol to the solution. Formation of the $C_{60}$ and $C_{70}$ charge-transfer complexes is demonstrated by the appearance of a new, red-shifted, charge-transfer absorption band in the visible absorption spectra of $C_{60}$ and $C_{70}$ fullerenes. The $C_{70}$/N, N-diethylaniline charge-transfer complexes also display a 828 nm luminescence band at 77K. This band is different from the parent $C_{70}$ luminescence.

Determination of Equilibrium Constant for the $C_{60}$ Charge-Transfer Complex In accordance with art known techniques such as that set forth in K. A. Connors, "Binding Constants. The Measurement of Molecular Complex Stability", John Wiley & Sons, New York, 1987, the equilibrium constant of $C_{60}$/N, N-diethylaniline charge-transfer complex is determined by studying the dependence of its absorption spectra as a function of the concentration of N, N-diethylaniline. Assuming 1:1 stoichiometry of $C_{60}$ fullerene to N, N-diethylaniline, the equilibrium constant is determined to be $0.18 \pm 0.04$. The extinction coefficient of the charge-transfer complex at 600 nm is determined from the optical density of the absorption spectra to be 3690 $M^{-1}cm^{-1}$ in N, N-diethylaniline.

Determination of Equilibrium Constant for the $C_{70}$ Charge-Transfer Complex In accordance with art known techniques such as that set forth in K. A. Connors, "Binding Constants. The Measurement of Molecular Complex Stability", John Wiley & Sons, New York, 1987, the equilibrium constant of $C_{70}$/N, N-diethylaniline charge-transfer complex is determined by studying the dependence of the absorption spectra of the complex as a function of the concentration of N, N-diethylaniline. Assuming 1:1 stoichiometry of $C_{70}$ fullerene to N, N-diethylaniline, the equilibrium constant is determined to be $0.4 \pm 0.06$. The extinction coefficient of the charge-transfer complex at 468 nm is determined from the optical density of the absorption spectrum to be $1.6 \times 10^{31\,4} M^{-1}{}_{cm}{}^{-1}$ in N, N-diethylaniline.

EFISH Studies of the $C_{60}$ Charge-Transfer Complex

As set forth in L. T. Cheng mentioned above, electrical-field-induced-second-harmonic (EFISH) generation is performed. This is done with $1.2 \times 10^{-2}$M Molar $C_{60}$ in N, N-diethylaniline solution. The second order polarizability and the dipole moment product, $\beta\mu$, is determined to be $9 \times 10^{-46}$ esu.

Photo-induced discharge analysis

The photoconductivity of a film of photoconductive composition according to the invention is measured by photo-induced discharge as shown schematically in FIG. 1. Generally, photoconductive film 60 (typical thickness of 0.1 to 20 micron) is cast onto a metal electrode 70 (typically aluminum or tin oxide) by known methods such as evaporation or spin-coating. The surface of film 60 is charged by a corona charger 50. The presence of charge on film 60, as is known in art, can be detected by electrostatic voltmeter 80. Upon exposure to light to induce photo discharge of film 60, electrons and holes are believed to be generated in film 60 which migrate to the surface of film 60 to discharge. The rate and the completeness of the photo-induced discharge gauge the photo conductive properties of film 60.

Figure 2:
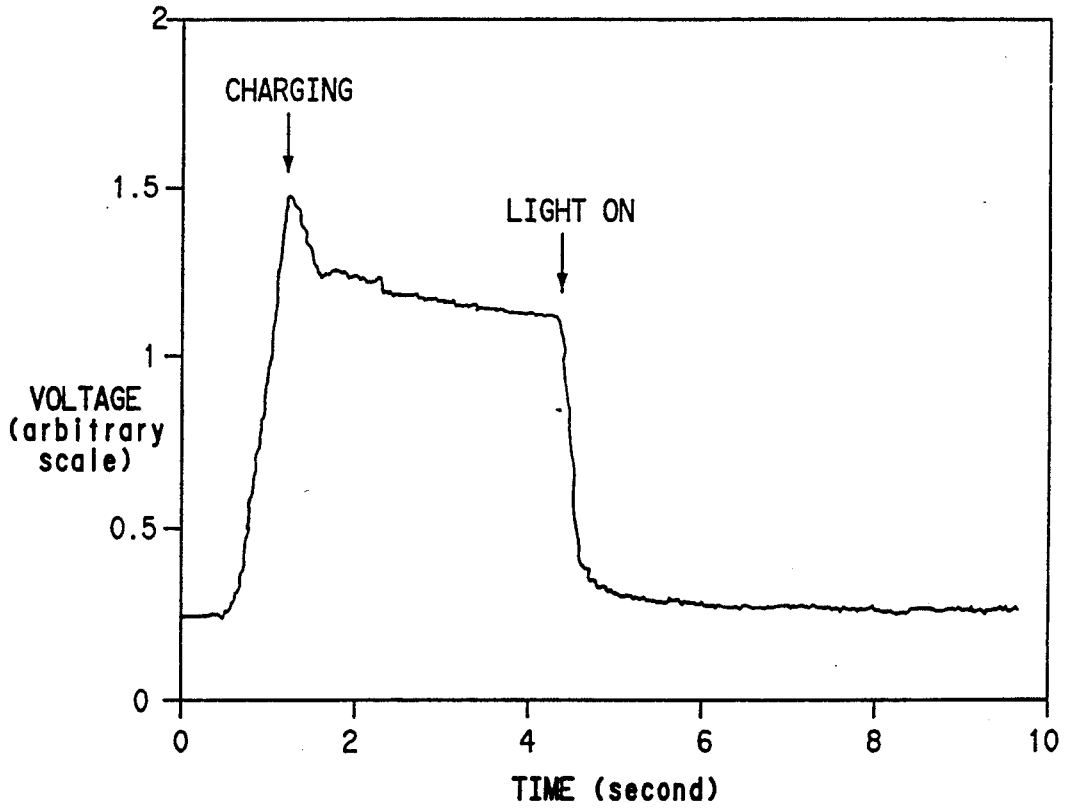
FIG. 2 is a typical trace from photo-induced discharge of the photoconductive materials of the invention.

A typical trace of the photo-induced discharge experiment is shown in FIG. 2, with onsets of charging and photo-induced discharging clearly marked.

EXAMPLE 1

Preparation an characterization of Fullerene containing Polyvinylcarbazole film One half gram of polyvinylcarbazole is added to 7 ml of toluene. After the polyvinylcarbazole is fully dissolved, 0.04 gram of a fullerene, containing $C_{60}$ and $C_{70}$ in a ratio of about 85 to 15, is added to the solution. The resulting solution is spin-coated onto an aluminum plate with a spin speed varying from 800 to 3000 rpm to provide a 1.85 mμ thick photoconductive film. The film is dried in an oven at 100° C. for 3–4 hours.

Photo-induced discharge analysis shows that the film is photoconductive. The 1.85 mμ thick film, formed as described above, when charged to a surface potential of nearly 35 volts, is completely discharged in less than 0.5 seconds upon flood exposure to a 50 watt tungsten lamp at a distance of 5 cm.

For comparison, the photoconductive performance of polyvinylcarbazole without fullerene is also measured. Polyvinylcarbazole, although a photoconductor, has photoconductive properties, as gauged by photo induced discharge, that are much less than polyvinylcarbazole with fullerene. Polyvinylcarbazole without fullerene, when evaluated under the photo discharge conditions described above, required more than 20 seconds to complete versus less than 0.5 seconds with fullerene This shows the surprising improvement in photoconductive properties performance due to use of fullerenes in photoconductive polymers.

EXAMPLE 2

Preparation and characterization of Polycarbonate film containing Fullerene/N, N-diedthylaniline Charge-transfer Complex One gram of poly(4, 4'-isopropylidenephenyl carbonate) and 0.6 gram of phenyl-bis(4-diethylamino-2-methyl-phenyl)methane (LG-1) are dissolved in 12 ml of dichloromethane. This solution is mixed in a 1:1 ratio with a N, N-diethylaniline solution saturated with fullerenes that contain $C_{60}$ and $C_{70}$ in a ratio of about 85 to 15. Sufficient (4, 4'-isopropylidenephenyl carbonate) and fullerenes are added to this solution until saturation. The photoconductive film is prepared by spin-coating the solution onto an aluminum plate with a spin speed of 750 rpm to yield a 1.80 mμ thick film.

Photo-induced discharge analyais shows that the film is photoconductive. The 1.80 mμ thick film, charged to a surface potential of nearly 400 volts is discharged to 200 volts in about 18 seconds upon flood exposure by a 50 watt tungsten lamp at a distance of 5 cm. This show the surprising improvement in photoconductive properties due to use of fullerenes in non photoconductive polymers.

EXAMPLE 3

Preparation and characterization of Poly(methylphenylsilane) film containing Fullerenes 0.01 gram of mixed fullerenes (~85% $C_{60}$, ~15% $C_{70}$) was dissolved in 6 ml toluene. 0.1 gram of poly(methylphenylsilane) was added to 3 ml of this solution. The solution was spin-coated onto an aluminum substrate at 1000 rpm for 80 seconds. The sample was then dried in a vacuum oven at 60° C. for one hour. The resultant film is 1.05 micron thick. 0.15 gram of poly(-methylphenylsilane) was further added to 2.5 ml of the above fullerene/poly(methylphenylsilane)/toluene solution to form a more viscous solution. After the same procedures of spin-coating and drying, a 4 micron film was formed.

Figure 3:
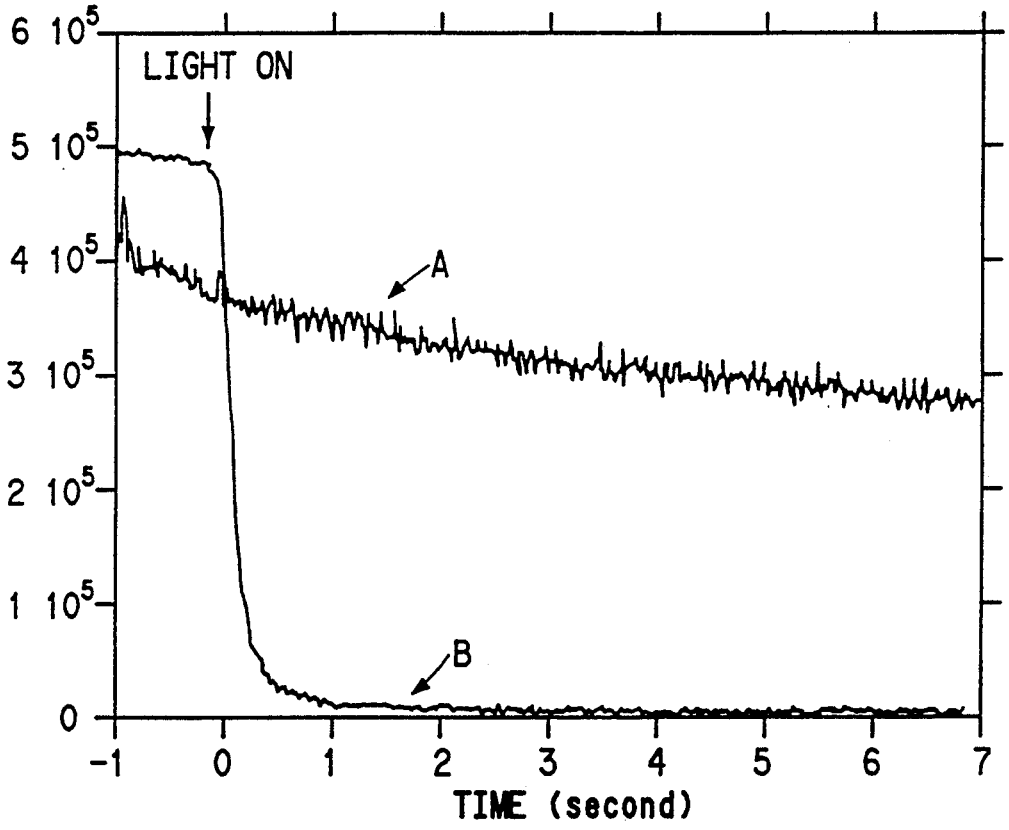
FIG. 3 is a trace from photo-induced discharge of a fullerene/poly(methylphenylsilane) of the invention denoted as A and poly(methylphenylsilane) denoted as B.

Both films show good photoconductivity as demonstrated by the photo-induced discharge experiments. As shown in FIG. 3, a film charged to a surface potential of $5\times10^5$ volts/cm was discharged completely within 0.5 seconds upon irradiation by a tungsten lamp (50 milliwatt/cm$^2$). Pure poly(methylphensylsilane) film did not show nay significant photo-induced discharge under comparable experimental conditions (FIG. 3).

Figure 4:
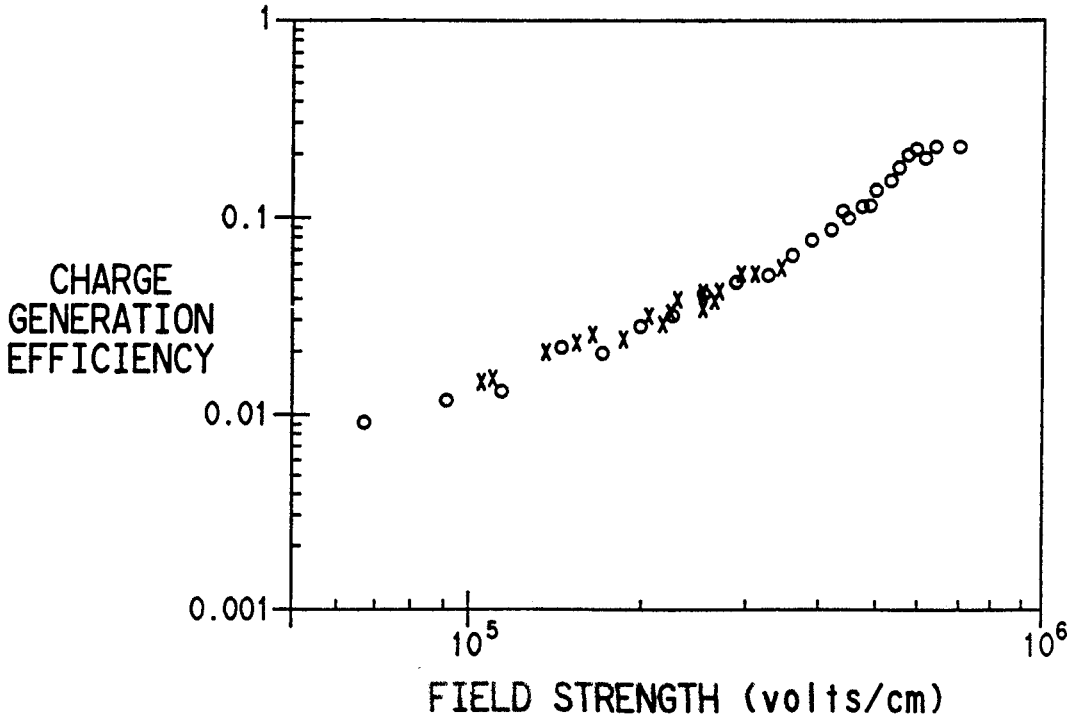
FIG. 4 is a plot of the field dependence of the charge generation efficiency of a 1 μm thick film of fullerene/-poly(methylphenylsilane) of the invention.

FIG. 4 shows the field dependence of the charge generation efficiency of the fullerene doped poly(methylphenylsilane) film. The film was 1 mμ thick. The irradiation source is a xenon lamp at 340 nm with a photon flux of $1.2\times10^{13}$ photons/(cm$^2$-sec). At a field strength of $\sim7\times10^5$ volts/cm, an efficiency of 0.17 is achieved.

From the foregoing description, one skilled in the art can easily ascertain the essential characteristics of this invention, and without departing from the spirit and scope thereof, can make various changes and modifications of the invention to adapt it to various uses and conditions.

What is claimed is:

1. A photoconductive composition comprising at least one organic material selected from the group of photoconductive polymers, low molecular weight electron donor compounds, or mixtures thereof, and from about 0.1 to about 50.0% by weight, based on the total weight of the photoconductive composition, of at least one fullerene compound having from about 20 to 1000 carbons.

2. The photoconductive composition of claim 1 wherein said fullerene compound is present in amount of from about 1 to about 20% by weight of said composition.

3. The photoconductive composition of claim 1 wherein said photoconductive polymers are selected from the group consisting of polysilane, polyvinylcarbazole, polystyrene, polyvinylxylene, poly-1-vinylnaphthalene, poly-2-vinylnaphtha-lene, poly-4-vinylbiphenyl, poly-9-vinylanthracene, poly-3-vinylpyrene, poly-2-vinylquinoline, polyindene, polyacenaphthylene, poly(3, 3'-dimethyldiphenylene-4, 4'), polyacrylamide, and polymethacrylamide.

4. The photoconductive composition of claim 1 wherein said low molecular weight electron donor compounds are selected from the group consisting of naphthalene, biphenyl, fluorene, anthracene, phenanthrene, acenaphthrene, acenaphthylene, chrysene, pyrene, 1, 4-dimethoxybenzene, diphenylamine, 2, 2'-dinaphthylamine, 1, 5-diethoxynaphthalene, 2-phenylindole, carbazole, phenothiazine, 2, 4-bis(4'-diethylaminophenyl)-1, 3, 4-oxidiazole, and 2, 4-bis(4'-diethylaminophenyl)-1, 3, 4-triazole.

5. A photoconductive composition comprising at least one organic material selected from the group consisting of nonphotoconductive polymers, low molecular weight electron donor compounds, or mixtures thereof, and from about 0.1 to 50% by weight, based on the total weight of the photoconductive composition, of a charge transfer complex comprising a fullerene and an electron donating component.

6. The photoconductive composition of claim 1 wherein said fullerene has at least twenty carbon atoms.

7. The photoconductive composition of claim 6 wherein said fullerene has at least sixty carbon atoms.

8. The photoconductive composition of claim 6 wherein said electron donating component has an oxidation potential less than about 1.38 volts measured against $Ag/Ag^+$.

9. The photoconductive composition of claim 3 wherein said electron donating component has an oxidation potential less than about 1.29 volts measured against $Ag/Ag^{30}$.

10. The photoconductive composition of claim 1 wherein the ratio of said electron donating component to said fullerene is in the ratio of about 1:3 to 6:1.

11. The photoconductive composition of claim 10 wherein the ratio of said electron donating component to said fullerene is in the ratio of about 1:1 to 3:1.

12. The photoconductive composition of claim 1 wherein said fullerene has either sixty or seventy carbon atoms, said electron donating component is N, N-diethylaniline, and the ratio of said N, N-diethylaniline to said fullerene is in the range of from about 1:1 to 3:1.

13. The photoconductive composition of claim 5 wherein said charge transfer complex is present in amount of from about 1 to about 20% by weight, based on the total weight of the photoconductive composition.

14. The photoconductive composition of claim 13 wherein said nonphotoconductive polymers are selected from the group consisting of polymethacrylate, polyaramide, poly(methyl methacrylate), poly(vinyl alcohol), copolymers of methyl methacrylate and methacrylic acid, copolymers of styrene and maleic anhydride, half ester-acids of maleic anhydride and polycarbonate.

15. The photoconductive composition of claim 13 wherein said low molecular weight electron donor compounds are selected from the group consisting of naphthalene, biphenyl, fluorene, anthracene, phenanthrene, acenaphthrene, acenaphthylene, chrysene, pyrene, 1, 4-dimethoxybenzene, diphenylamine, 2, 2'- dinaphthylamine, 1, 5-diethoxynaphthalene, 2-phenylindole, carbazole, phenothiazine, 2, 4-bis(4'-diethylaminophenyl)-1, 3, 4-oxidiazole, and 2, 4-bis(4'-diethylaminophenyl)-1, 3, 4-triazole.

16. A photoconductive element comprising the photoconductive composition of claim 1 or claim 5.

17. A process for image reproduction, comprising applying a surface electrostatic charge to a photoconductive element comprising the photoconductive composition of any one of claim 1 to claim 16, exposing said charged element to a source of electromagnetic radiation to form an electrostatic latent image, and developing said latent image.

* * * * *